US008511506B2

(12) United States Patent
Ringler

(10) Patent No.: US 8,511,506 B2
(45) Date of Patent: Aug. 20, 2013

(54) TRANSPORT CASES WITH HINGED SIDE PARTS MADE OF PLASTIC

(75) Inventor: Werner Ringler, Weisendorf (DE)

(73) Assignee: IFCO Systems GmbH, Pullach (DE)

( * ) Notice: Subject to any disclaimer, the term of this patent is extended or adjusted under 35 U.S.C. 154(b) by 162 days.

(21) Appl. No.: 12/985,949

(22) Filed: Jan. 6, 2011

(65) Prior Publication Data

US 2011/0163484 A1 Jul. 7, 2011

Related U.S. Application Data

(63) Continuation of application No. 11/231,380, filed on Sep. 21, 2005, now abandoned.

(51) Int. Cl.
*B65D 8/04* (2006.01)

(52) U.S. Cl.
USPC ..... 220/600; 220/4.28; 220/7; 220/624; 220/645

(58) Field of Classification Search
USPC ..... 220/4.28, 7, 600, 628, 645; 428/35.7; 383/204; 264/524
See application file for complete search history.

(56) References Cited

U.S. PATENT DOCUMENTS

| | | | | |
|---|---|---|---|---|
| 4,626,005 | A | 12/1986 | Stifter | |
| 5,114,791 | A * | 5/1992 | Stahlke et al. | 428/419 |
| 5,538,153 | A | 7/1996 | Marovskis et al. | |
| 5,750,155 | A | 5/1998 | Eckardt et al. | |
| 5,884,810 | A | 3/1999 | Vizcarra et al. | |
| 5,967,356 | A | 10/1999 | Laarhoven et al. | |
| 6,029,840 | A | 2/2000 | Brauner | |
| 6,200,663 | B1 | 3/2001 | Zuser et al. | |
| 2002/0044447 | A1 | 4/2002 | Melson et al. | |
| 2002/0108951 | A1 * | 8/2002 | Zelko | 220/7 |
| 2003/0039904 | A1 * | 2/2003 | Camp et al. | 430/11 |
| 2003/0146213 | A1 * | 8/2003 | Kellerer et al. | 220/7 |
| 2003/0190488 | A1 * | 10/2003 | Peduto | 428/474.4 |
| 2004/0160720 | A1 | 8/2004 | Yamanashi et al. | |
| 2004/0238209 | A1 | 12/2004 | Yuri et al. | |

FOREIGN PATENT DOCUMENTS

| | | |
|---|---|---|
| AT | 007002 | 7/2004 |
| DE | 3823650 | 1/1990 |
| DE | 4022884 | 1/1992 |
| DE | 4319381 | 12/1994 |
| DE | 9421487 | 1/1996 |
| DE | 19810312 | 9/1999 |

(Continued)

OTHER PUBLICATIONS

"CC Eurocrate"; Container Centralen, No. 003813301,registered Jul. 7, 2005; 2 pages.
"Einfluss des Prozessmediums"; Feb. 2003, Journal Kunstoffe, p. 53.
"First Water-Assist Moulded Crate"; Vilsteren, Schoeller Wavin Systems, Oct. 2004; 2 pages.
RCD Online; Boxes "EUROLOCARNO": published Apr. 19, 2005; Design No. 000177464-0002, Clever Box International B.V.; 6 pages.
Egger, Peter et al.; "Dem Experimentierstatus entwachsen"; Sep. 2004; Journal Kunststoffe, pp. 196-202.
Michaeli, Walter et al.; "Herstellung polymerer Hohlkoerper mit der Wasserinjedktionstechnik (WIT)"; Institut fuer Kunstoffverarbeitung (IKV), Aachen, Germany; 12 pages.

*Primary Examiner* — Anthony Stashick
*Assistant Examiner* — Elizabeth Volz
(74) *Attorney, Agent, or Firm* — Michael A. Glenn; Perkins Coie LLP

(57) ABSTRACT

A transport case 1 with hinged side parts 3, 4 made of plastic is provided, whereby the height of the hinged side parts 3, 4 is greater than 16 centimeters or the permissible load of the transport case is greater than 16 kg, and wicket-shaped hollow stiffening strips 11, 12 are present in the hinged side parts 3, 4. The stiffening strips 11, 12 formed by injection of liquid have a surface roughness that is less than 10 micrometers.

14 Claims, 2 Drawing Sheets

(56) References Cited

FOREIGN PATENT DOCUMENTS

| | | |
|---|---|---|
| DE | 10018905 | 10/2001 |
| EP | 0131249 | 1/1985 |
| EP | 0396728 | 11/1990 |
| EP | 0662034 | 7/1995 |
| EP | 0770552 | 5/1997 |
| EP | 0786412 | 7/1997 |
| EP | 1484154 | 12/2004 |
| WO | WO98/26931 | 6/1998 |

* cited by examiner

TRANSPORT CASES WITH HINGED SIDE PARTS MADE OF PLASTIC

CROSS-REFERENCE TO RELATED APPLICATIONS

This application is a continuation of U.S. patent application Ser. No. 11/231,380, filed Sep. 21, 2005 now abandoned, which claims priority to German Patent Application No. 202004018927.5 filed Dec. 7, 2004, both of which is incorporated herein by this reference thereto.

BACKGROUND OF THE INVENTION

1. Field of the Invention

The invention relates to transport cases with hinged side parts made of plastic, whose side parts are subject to special technical demands. The side parts have either a board height that is greater than 16 centimeters or they must reliably withstand loads greater than 16 kg. In addition, the hinged side parts are provided with wicket-shaped hollow stiffening strips. Such cases are used for logistical purposes. The cases are generally stackable and many different types of unit items can be transported in them.

2. Description of the Related Art

In contrast to rigid cases, when the side parts are hinged the problem is more likely to occur that one individual side part is not sufficiently torsionally rigid. This basic problem intensifies as the board height of the side parts increases and as the weight' of the load increases. Because as the surface area required for the side parts increases and as the load pressure increases, the strength of the plastic is no longer adequate to guarantee sufficient torsional rigidity. One skilled in the art uses stiffening strips to counter this problem. Known in particular from the prior art in accordance with EP 0 396 728 B2 (FIG. 7) are wicket-shaped hollow stiffening strips. The invention starts from this prior art.

In contrast to rigid cases, when the side parts are hinged the problem is more likely to occur that one individual side part is not sufficiently torsionally rigid. This basic problem intensifies as the board height of the side parts increases and as the weight' of the load increases. Because as the surface area required for the side parts increases and as the load pressure increases, the strength of the plastic is no longer adequate to guarantee sufficient torsional rigidity. One skilled in the art uses stiffening strips to counter this problem. Known in particular from the prior art in accordance with EP 0 396 728 B2 (FIG. 7) are wicket-shaped hollow stiffening strips. The invention starts from this prior art.

In terms of the technical starting point for the invention, however, another problem remains unresolved that has to do with the fact that the known hollow U-leg is produced by injecting gas. The pressure and flow conditions that can be produced by injecting gas are not adequate for producing a truly smooth external skin of the hollow stiffening channels. This means the hygiene and carrying comfort of the transport cases is negatively affected in particular when the upper edge of the wicket-shaped reinforcing strip is used simultaneously as a handle.

SUMMARY OF THE INVENTION

The object of the invention is therefore to embody in the aforesaid transport cases the exposed stiffening strips such that they are particularly hygienic, i.e., smooth and dirt-repellant.

This object is attained in a transport case in accordance with the preamble to claim 1 in that the stiffening strips formed by the injection of liquid have a surface roughness that is less than Rz=10 micrometers. Using the pressure and flow conditions attainable with liquid injection, the surfaces of the stiffening strips, in particular the surfaces of the handle, are so smooth that transport by hand can be performed comfortably and hygienically while the exposed surface is dirt-repellant and easy to clean.

Useful further developments of the transport case follow from the dependent claims. For instance, it is provided that at least one of the stiffening strips forms a handle on at least one of the side parts. For this, a through-grip is exposed, preferably on the narrow side parts, that then forms a handle with the stiffening strip running on the upper edge. The longer side parts preferably do not have a handle, however a handle can also be provided there in certain circumstances.

When the stiffening strips are formed by injecting liquid shortly after the injection molding of the plastic, preferably it is water that is injected. However additives can also be added to the water.

The hinged side parts of the transport case are preferably produced by injection molding of one plastic component. However, it is also conceivable to inject a second plastic component prior to or after injecting liquid. It is preferred to detachably snap the hinged side parts to a profiled plastic bottom. The shorter side parts are preferably provided with four snap locks that snap onto the longer side parts. Thus the hinged side parts are locked into the transport position at the four corners of the case.

A width of approximately 50 to 60 cm is preferred for the shorter side part that is provided with a handle. The longer side part, preferably without a handle, is for instance approximately 80 cm wide. Because of the liquid-injected stiffening strips a longer side part of this size (approx. 80 cm wide, more than 20 cm high) and a handle side part of that size (approx. 50 cm wide, more than 20 cm high) obtains excellent connection stiffness combined with particularly good surface roughness.

Deviating from the protected technical teaching in EP 396 728 B2,

- the side parts are hinged in order to be able to facilitate return transport of the empty cases with less volume;
- the side parts are higher than 16 centimeters in order to make possible large loads of fruits or vegetables, but also of any other type of unit item that is more than 16 kg in weight;
- the wicket-shaped stiffening strips are formed by water injection in order to shorten the cycle time using more rapid cooling after the injection molding; and,
- the surface roughness Rz of the stiffening strips is less than 10 micrometers.

In the field of transport cases that are produced by plastic injection molding with the injection of an additive, although there has been technological development in the past 15 years, the inventors are not familiar with any prior art that combines with one another in an advantageous manner all of the features of patent claim 1.

Thus, known from patent DE 38 23 650 C2 is a bottle case that is used for instance to transport beer bottles. For attaining the object of creating the handle area of the case such that it does not cut into the hand of the person carrying it, the case is designed such that a thickening is created on the handle edge by means of a hollow space. In accordance with FIG. 10, the thickening can have an interior hollow space produced by gas injection.

Patent EP 396 728 B2 discloses a bottle case made of plastic with four side walls. At least the location where a bar 3 of the bottle case forms the handle, hollow stiffening channels are provided that are formed by injecting gas and that are closed at the ends. In accordance with FIG. 7, the hollow stiffening channel can be embodied wicket-shaped.

Known from Offenlegungsschrift DE 40 22884 Al is another bottle case. In this bottle case the handle is covered by a second, softer plastic component. The core element of the handle, along with the case body, is produced as a single-piece injection molded piece made of polyethylene; in accordance with FIG. 5, the outer element can be applied using a second injection molding process. Thus, overall the bottle case can be produced using dual-component injection molding. The core element 2 of the handle is embodied as a closed hollow profile with a basic O-shape.

Utility model DE 94 21 487 U1 discloses load carriers, in particular containers, pallets, elements of a container system, and the like that are produced from plastic. The load carriers accommodate unit items, like bags, bottles, or similar packagings. They must be embodied rigid enough for this purpose. Therefore the bottom or walls of the load carrier contain hollow spaces that are embedded in the plastic, that are closed to the outside, and that are formed by injecting gas.

Another case produced by injection molding in conjunction with injecting gas is known from patent EP 770 552 B 1. This is in particular a bottle case, the handle edge of which is embodied to conform to the hand. For this, the free sides of the handle are embodied wavy in shape, corresponding to the fingers. Two different plastics are injected in the area of the handle and no sunken locations occur due to the gas pressure.

Offenlegungsschrift DE 100 18905 Al discloses a method for producing a plastic part by injecting liquid plastic into a mold. In particular this applies to production of a handle for a plastic case. The hollow handle is produced by 10 injecting a liquid medium, in particular water, at high pressure and high speed. For attaining the object of finding a simpler and more cost-effective method than gas injection, water is pressed into the liquid plastic so that the finished hollow space has approximately uniform wall strength overall.

Finally, the application for EP 1 484 154 Al discloses a plastic element, in particular a plastic handle, that is manufactured using an injection molding process. In this injection molding process, two injection units in accordance with dual-component injection molding are used, as well as a nozzle unit for injecting a powder or foam into the interior of the supporting injection molded part. The hollow space in the supporting injection molded part is then filled with a powder or foam, while the second plastic layer at the surface of the supporting injection molded part is soft.

In contrast to this, the invention describes a transport case with hinged side parts made of plastic, the height of which is greater than 16 centimeters (or that must withstand a load of more than 16 kg in weight) and that are reinforced by wicket-shaped hollow stiffening strips. The stiffening strips are formed by injecting liquid and have a particularly low surface roughness that is less than Rz=10 micrometers. The invention is explained using FIGS. 1 and 2 in greater detail.

BRIEF DESCRIPTION OF THE DRAWINGS

Accompanying the specification are figures which assist in illustrating the embodiments of the invention, in which.

DETAILED DESCRIPTION OF THE INVENTION

Figure 1:
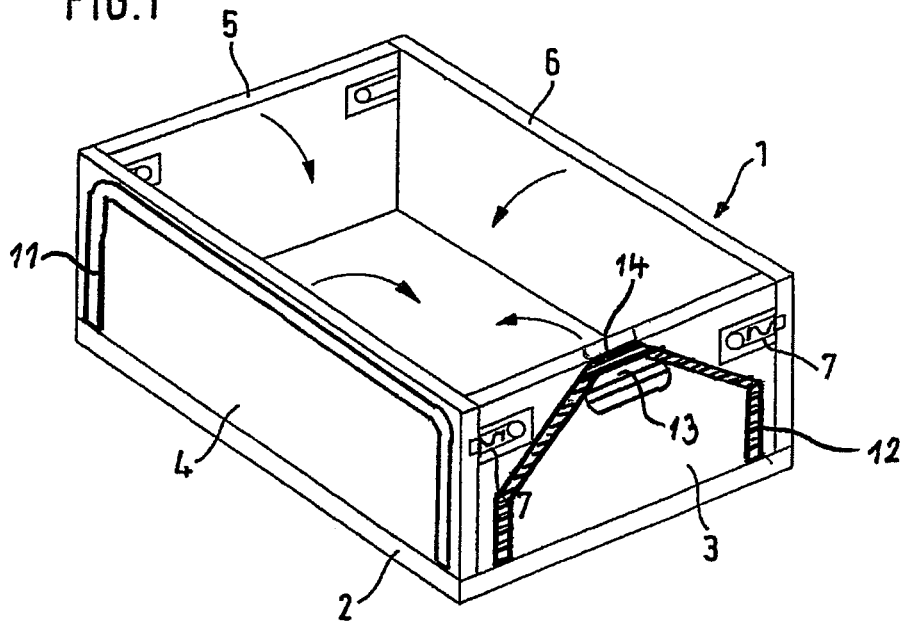
FIG. 1 is a transport case 1 in accordance with the invention, including a bottom 2 and hinged side parts 3, 5 with hollow stiffening strips 12 as well as hinged side parts 4, 6 with hollow stiffening strips 11.

FIG. 1 illustrates a transport case 1 in accordance with the invention. The transport case 1 includes a bottom part 2 and four hinged side parts 3, 4, 5, and 6. The smaller side parts 3, 5 are reinforced with wicket-shaped reinforcing strips 12. In the embodiment of the less wide parts 3, 5, two snap locks 7 are located outside of the wicket shape in the upper comers of the side parts 3, 5. A handle 14 is created by means of a through-grip 13 below the stiffening strip 12. A width of approximately 50 to 60 cm is preferred for these side parts 3 and 5.

The longer parts 4 and 6, for which a width of approximately 80 cm is preferred, are likewise reinforced by wicket-shaped stiffening strips 11. No handle is provided in this exemplary embodiment of a side part. In addition, no snap locks are provided in the side parts 4, but rather only recesses into which the snap locks 7 lock.

The shorter side parts 3, 5 are preferably 50 cm wide. The board height at which it makes sense to use the stiffening strips 11 and 12 begins at approximately 20 cm. Despite the through-grip 13 and the handle 14, such a side part 3 is even stiff enough when the snap locks 7 are released and the side parts 3 do not provide support on both sides. The large surface-area side part 4 is also stiff enough, both when there is a heavy load of items in the high case when it is locked and after the snap locks 7 have been unlocked in the snapped-on condition.

In the inventive transport case, the stiffening strips 11, 12 (and in particular also the handle 13, 14) are smooth and dirt-repellent enough that optimum hygienic working conditions are provided.

Figure 2:
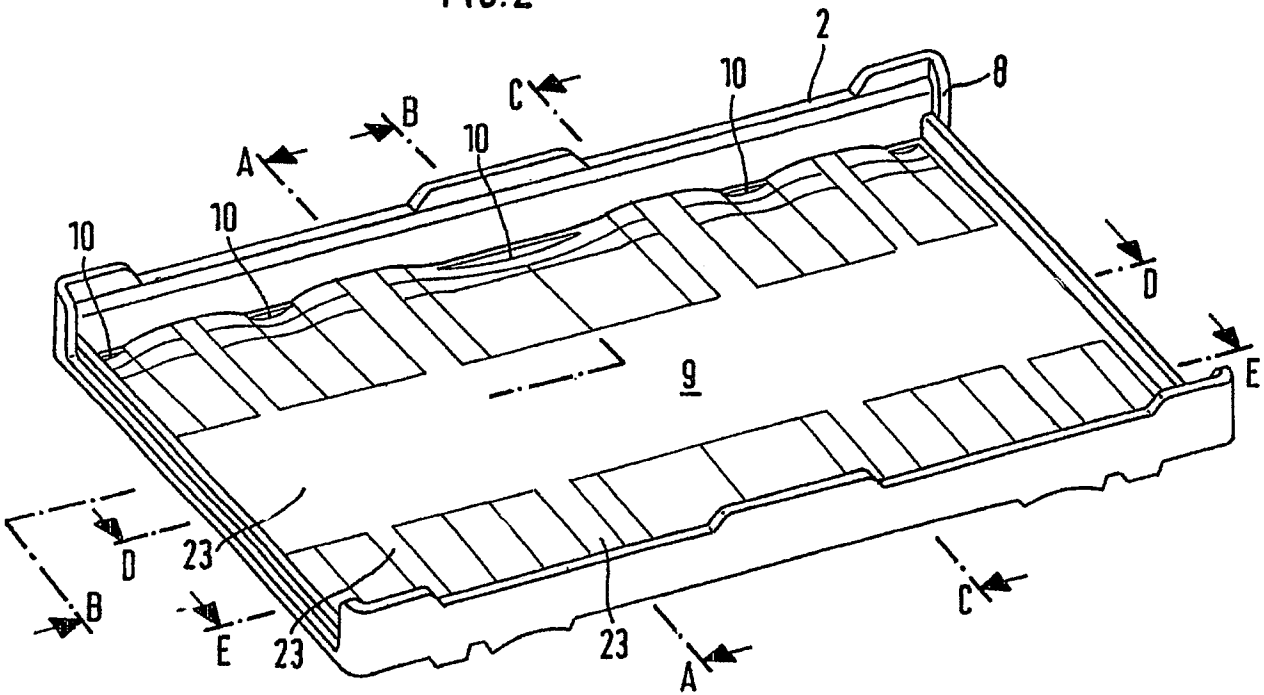
FIG. 2 is a bottom 2 made of profiled plastic to which the reinforced side parts (for instance 3 and 4) are hinged and detachably locked.

FIG. 2 illustrates a bottom part 2 made of plastic that is preferred for the inventive transport case 1. Four hinged side walls 3, 4, 5, and 6 are arranged encircling this bottom plate 2 such that they can be snapped onto the bottom plate 2 (see FIG. 1). The bottom plate 2 has a largely rectangular frame 8 in which a bottom profile 9 with a flat surface extends. For stiffening, the bottom profile 9 has a plurality of waves 10 that are formed by curvature of the bottom profile 9 in a plurality of spatial directions. Provided between the areas with waves 10 are horizontal sections 23 that separate the areas with waves 10 from one another.

A frame 8 with side wall continuations also belongs to the bottom plate 2. The waves 10 are provided largely along the longitudinal sides and in the corner areas of the bottom profile 9. The sectional views A, B, C, D, and E are not required for understanding the present invention. What is important is that the hinged side walls 3, 4, 5, and 6 in accordance with FIG. 1 can be detachably locked to the bottom plate 2 in accordance with FIG. 2. Thus it is possible to exchange individual damaged side parts.

Returning to FIG. 1, a locking mechanism 7 for locking the hinged side walls 2, 3 in the upright position is provided at adjacent side walls (e.g., 3, 4). A locking latch for the lock 7, which is arranged on one side wall (preferably the short side wall) engages in a lock recess of the adjacent side wall 4. The lock 7 includes a slide element that can be displaced against the elastic force of an elastic element.

The present invention may be embodied in other specific forms without departing from its spirit or essential characteristics. The described embodiments are to be considered in all respects only as illustrative and not as restrictive. The scope of the invention is, therefore, indicated by the appended claims and their combination in whole or in part rather than by the foregoing description. All changes that come within the meaning and range of equivalency of the claims are to be embraced within their scope.

The invention claimed is:

1. A method for producing a transport case having hinged side parts and wicket-shaped hollow stiffening strips in said hinged side parts, comprises forming said stiffening strips by injecting said stiffening strips with liquid, wherein said stiffening strips are formed with a surface roughness that is less than Rz=10 micrometers.

2. The method of claim 1, wherein said stiffening, strips are formed with a low surface roughness by water as the injection liquid.

3. The method of claim 1, wherein said hinged side parts are produced from plastic using single-component injection molding.

4. The method of claim 1, wherein said hinged side parts are produced from plastic using dual-component injection molding.

5. The method of claim 1, wherein said hinged side parts are formed of plastic.

6. The method of claim 1, wherein said hinged side parts are formed with a height greater than 16 cm.

7. The method of claim 1, wherein said transport case is formed with a permissible load greater than 16 kg.

8. The method of claim 1, wherein at least one of said stiffening strips is formed to form, together with a through-grip, a handle on one or more of said hinged side parts.

9. The method of claim 8, wherein said one or more side parts on which said handle is formed is formed approximately 50 cm wide.

10. The method of claim 8, wherein said one or more side parts on which a handle is not formed is formed approximately 80 cm wide.

11. The method of claim 1, wherein said hinged parts are formed to be detachably snapped onto a profiled bottom.

12. The method of claim 11, wherein said side parts are formed to be locked in a transport position by snap locks.

13. The method of claim 11, wherein said profiled bottom is plastic.

14. The method of claim 11, wherein a shape of said profiled bottom includes a plurality of structural waves mutually separated by flat sections.

* * * * *